US007731515B2

(12) United States Patent
Nicholson

(10) Patent No.: US 7,731,515 B2
(45) Date of Patent: Jun. 8, 2010

(54) HIGH VOLTAGE WET MATEABLE ELECTRICAL CONNECTOR

(75) Inventor: Joseph Allan Nicholson, Broughton-in-Furness (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 55 days.

(21) Appl. No.: 12/063,004

(22) PCT Filed: Aug. 3, 2006

(86) PCT No.: PCT/GB2006/002882

§ 371 (c)(1), (2), (4) Date: Feb. 21, 2008

(87) PCT Pub. No.: WO2007/023250

PCT Pub. Date: Mar. 1, 2007

(65) Prior Publication Data

US 2008/0227322 A1 Sep. 18, 2008

(30) Foreign Application Priority Data

Aug. 26, 2005 (GB) ..... 0517496.6

(51) Int. Cl.
*H01R 13/523* (2006.01)

(52) U.S. Cl. ..... 439/201

(58) Field of Classification Search ..... 439/199–201
See application file for complete search history.

(56) References Cited

U.S. PATENT DOCUMENTS 3,261,909 A * 7/1966 Rust et al. ..... 174/153 R
4,142,770 A 3/1979 Butler
5,171,158 A * 12/1992 Cairns ..... 439/199
5,685,727 A * 11/1997 Cairns ..... 439/139

FOREIGN PATENT DOCUMENTS

| | | |
|---|---|---|
| EP | 0493375 | 7/1992 |
| EP | 0902505 | 3/1999 |
| WO | 97/40411 | 10/1997 |

* cited by examiner

*Primary Examiner*—Neil Abrams
(74) *Attorney, Agent, or Firm*—Daryl R. Wright; Brandon S. Clark; Rodney V. Warfford

(57) ABSTRACT

An electrical connector is provided for use in establishing watertight connections, such as for subsea applications. The connector comprises a receptacle component (100) that includes a fluted, insulated male contact pin (52) with an isolation tube (5) substantially surrounding the insulated male contact pin over at least part of its length and containing oil therein, and a plug component (200) that includes a sliding contact pin assembly (19) and a release mechanism (40). The release mechanism (40) enables linear tolerance sliding action between the receptacle component and the plug component after establishing electrical communication between the mating components. The sliding contact pin assembly further includes a shuttle pin (24) that is urged rearwardly during mating to operate the release mechanism, thereby allowing the male contact pin and front contact band (20) to move relative to the central spring support rod (30) of the plug component.

15 Claims, 11 Drawing Sheets

HIGH VOLTAGE WET MATEABLE ELECTRICAL CONNECTOR

The present invention relates to a wet mateable electrical connector for use in providing high voltage power to systems in deepwater or offshore subsea equipment. Examples of such systems are submersible pumps or motors for separation and power distribution systems.

Hydrocarbons which are in the form of heavy crude oil are difficult to extract through conventional means, other than through electrical submersible pumps (ESP's). There is a need for high horse power motors (1.5-2.0 MW) for subsea wellheads to extract such hydrocarbons. Such systems require electrical connection through a subsea wellhead in shallow or deep water (approximately 5-3000 m), where space for the connection through the wellhead is restricted. Further, wellhead electrical connectors have to cope with high differential pressures up to about 5000 psi and temperatures up to about 120° C.

High horsepower pump systems are more economical to run in deepwater and it is desirable to increase the system voltages from around 4 kVac to 8 kVac. Additionally, the need for subsea power connectors is increasing and even higher system voltages of up to 36 kV will be required for long distance power distribution.

Wet mateable connectors are known where the electrical connection is made in an oil filled environment and where the openings for the contacts are sealed by means of a spring energised stopper or shuttle pin. Insulation blocks with labyrinth seals or flexible walled diaphragms are known to be used. It is also possible to use sliding contacts to allow the connector to achieve a tolerance to linear engagement, required in wellhead applications due to the tolerance stack-ups on the wellhead parts and lock-down mechanisms. However, such connector systems are lacking when it comes to high voltage connection systems because their insulation around the male contact pin is exposed to seawater. There is therefore a need for a wet mateable connector which meets the requirements for deep water usage and is reliable at these high voltage levels. According to the present invention there is provided an electrical connector for use in subsea applications, the connector comprising: a receptacle component comprising a fluted, insulated male contact pin and a plug component comprising a contact assembly; wherein, on engagement of the receptacle component and plug component in use, a watertight electrical connection is formed between the male contact pin and the contact assembly; wherein the receptacle component further comprises an isolation tube substantially surrounding the insulated male contact over at least part of its length and containing oil therein, in use.

The isolation tube may be made from metal to provide a non-permeable barrier or from an insulating material such as polyetheretherketone (PEEK), glass reinforced plastic (GRP) or a ceramic material to provide additional insulation to the male contacts.

The receptacle component may further comprise an oil filled wiper system which feeds, in use, the male contacts with insulation oil such as dielectric oil. The wiper system is filled with insulation oil and when the wiper system is displaced by the plug component on engaging of the receptacle component and plug connector in use, the oil slides down the male contacts and isolation tubes. At all times an oil reservoir is provided to maintain the insulation and protection to the male contact. The flutes in the insulation around the male contact and the isolation tube improve oil circulation and exchange between the male contact and the wiper system.

The connector may further comprise a first cone seal arranged to seal around an engaging end of the insulated male contact pin and a second cone seal arranged to seal around an engaging end of the contact assembly, wherein a seal is formed between the first and second cone seals on engaging of the plug and receptacle components in use. The cone seals effectively form seals between the mating connector components to provide additional insulation during connection. Additionally this extends the voltage field around each contact to form a smooth electrical field pattern and lower voltage gradient through the seal interfaces, thereby reducing tendency for electrical tracking.

The connector of the present invention has a highly managed level of insulation. The male contacts are environmentally protected and the connector can provide a sealed insulation system or closed system approach. The electrical insulation is critical to the connector performance and a closed system approach prevents the interaction of fluids such as glycols, seawater and hydraulic oils and marine organisms which can affect a connector's performance significantly over the life of the connection system, which may be twenty years or more.

The receptacle component may comprise three male contact pins and isolation tubes as defined above and a substantially triangular diaphragm surrounding the isolation tubes. The triangular shape of the diaphragm provides a large volume to accommodate displacement of oil during engagement of the receptacle component with the plug component.

Additionally, the plug component may further comprise a release mechanism arranged to align, in use, the male contact pin and the contact assembly prior to full engaging of the receptacle and plug components. The release mechanism may comprise a shuttle member moveable within the contact assembly and a release means; wherein on engaging of the plug component and receptacle component in use, the shuttle member is arranged to release the release means to allow full engagement of the plug component and receptacle component.

Examples of the present invention will now be described with reference to the accompanying drawings, in which.

Figure 1:
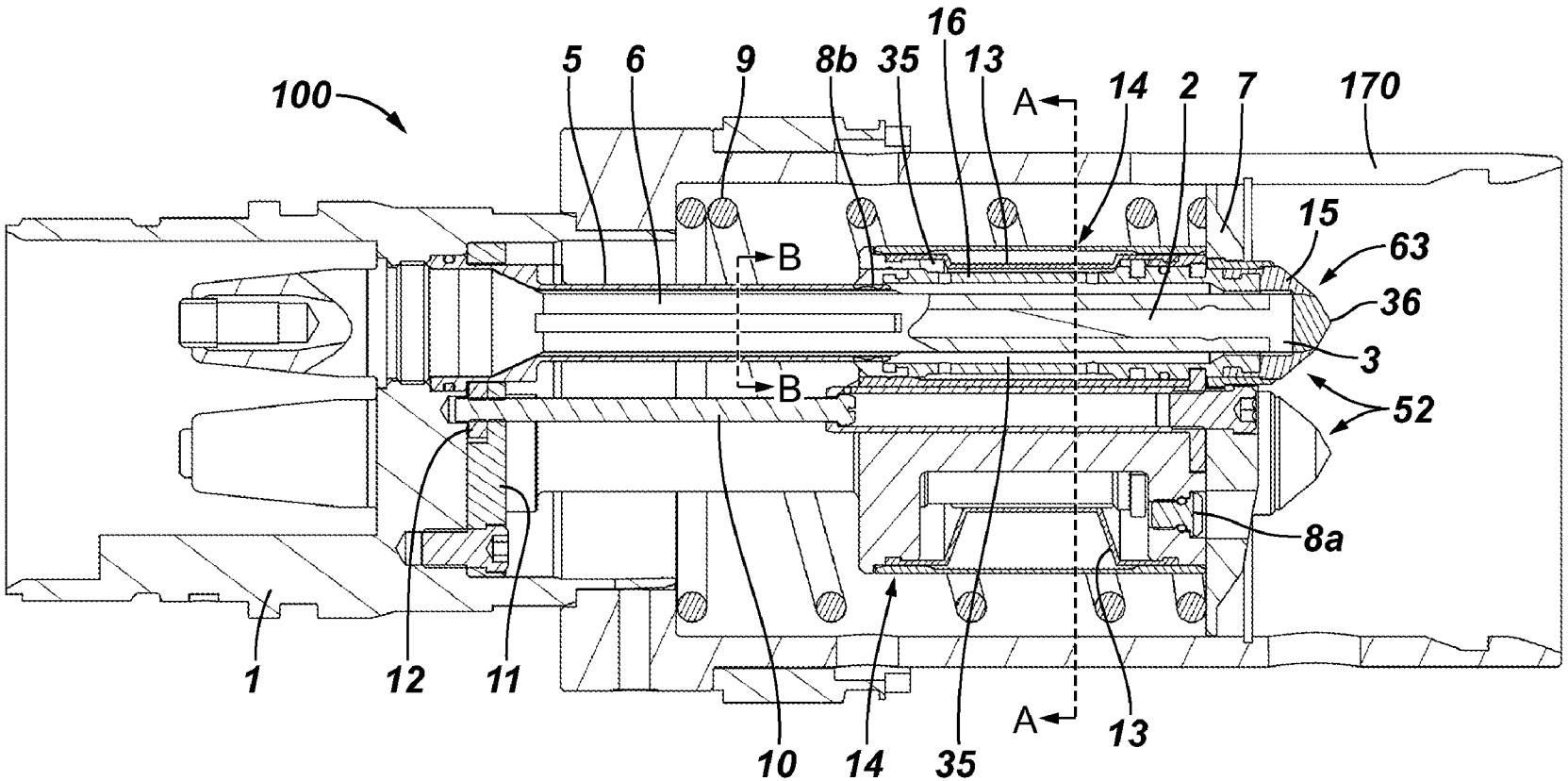
FIG. 1 is a longitudinal cross-sectional view of an example receptacle component according to the present invention.
Figure 2:
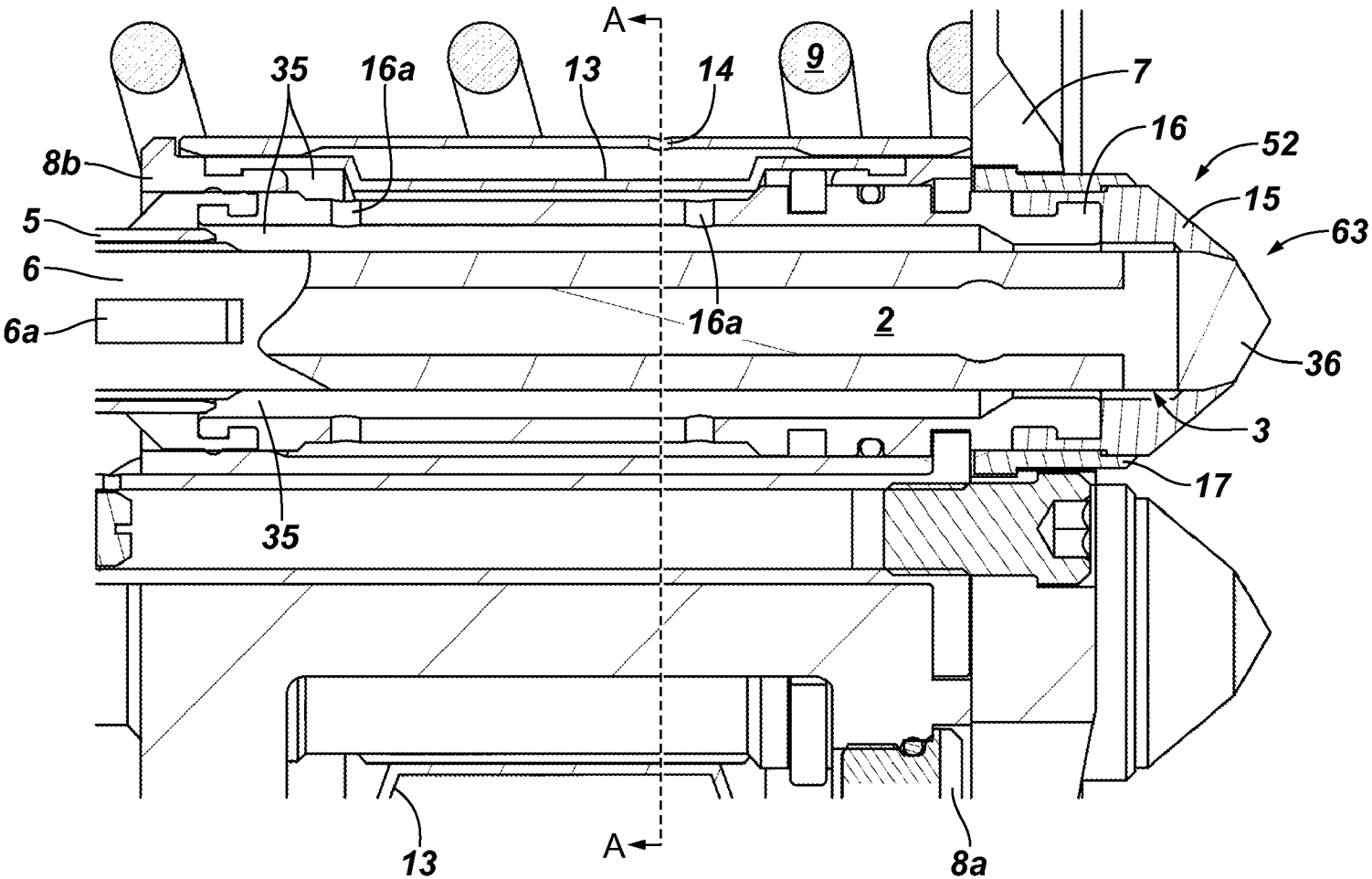
FIG. 2 is an enlarged view of the receptacle component in FIG. 1.
Figure 3:
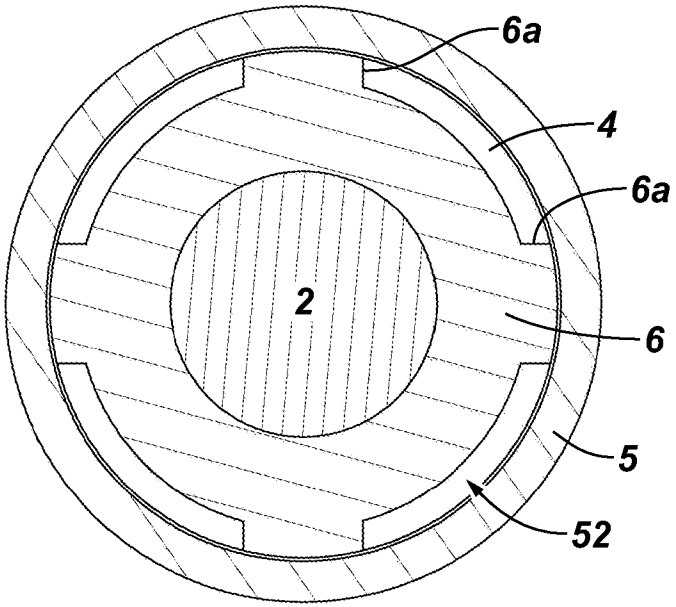
FIG. 3 is a section of the receptacle component shown in FIG. 1 taken at B-B.

A receptacle component 100 of a connector according to illustrative embodiments of the present invention will now be described with reference to FIGS. 1 to 4. FIG. 1 and FIG. 2 show a receptacle component 100 with three male pins 52 (although only two male pins may be seen in this figure) and a spring energized wiper assembly 7 manipulating compartments filled with oil 35. The body 1 houses male contact pins 52 which are each insulated along their length with thermoplastic insulation 6 such as PEEK and have an exposed contact band 3. Each of the insulated male contact pins 52 has a central metallic core 2 made from a material that allows high current transmission, such as a high conductivity copper alloy. FIG. 3, which is a section through B-B of FIG. 1, more clearly shows the insulation 6 around pin core 2. There are external flutes 4 formed between protrusions 6*a* in the insulation 6 to allow oil passage between the male contact pin 52 and a surrounding isolation tube 5. The isolation tube 5 can be metallic or plastic to provide additional insulation and extends part of the way along the male contact pin 52.

The compartments of the wiper assembly 7 are filled with dielectric oil 35 through a port 8*a* under vacuum to remove air. Front cone seals 15 seal the male contact pins 52 via the respective plug noses 36, clips 17, and insulating tubes 16 and rear lip seals 8*b* seal on to the isolation and insulation tubes 5 and 16. The wiper assembly 7 is energized towards the contact bands 3 through a spring 9 and retained by a threaded pin 10, which can be adjusted through a plate 11 and a backing nut 12 to set its position.

Figure 4:
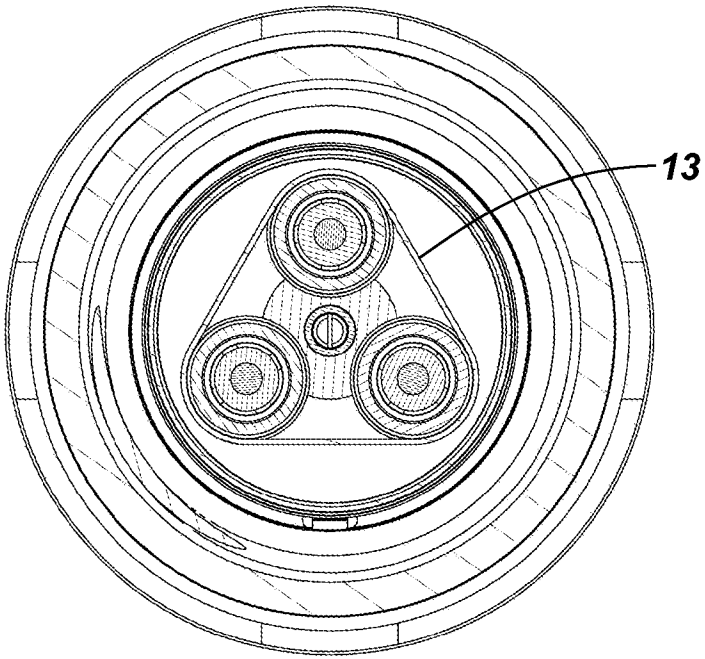
FIG. 4 is a section of the receptacle component shown in FIG. 1 taken at A-A.

The receptacle component 100 further comprises a pressure balancing diaphragm 13. Because of the difference in diameter between the male contact pins 52 and their respective isolation tubes 5, the diaphragm 13 has to allow for expansion when displaced. To accommodate this, the diaphragm 13 is triangular in shape, as shown in FIG. 4, which is a section through A-A of FIG. 1. A port 14 pressure balances the wiper oil 35 by allowing sea-water depth pressure to act on the outward surface of the diaphragm 13.

Referring to FIG. 2, the front cone seals 15 are included in front cone seal assemblies 63 along with corresponding plug noses 36. Each cone seal 15 is made of a low permittivity elastomer with high dielectric strength and the cone seal assembly 63 is mounted on the end of an insulating tube 16, which has holes 16*a* therein for the free passage of oil. The cone seals 15 of the front cone seal assemblies 63 are held in place by clips 17, in which the clips 17 and cone seals 15 also provide an abutment to mating concave insulation cones 18 on plug component 200 (see FIG. 5 and FIG. 6), setting the seal engagement height.

Figure 5:
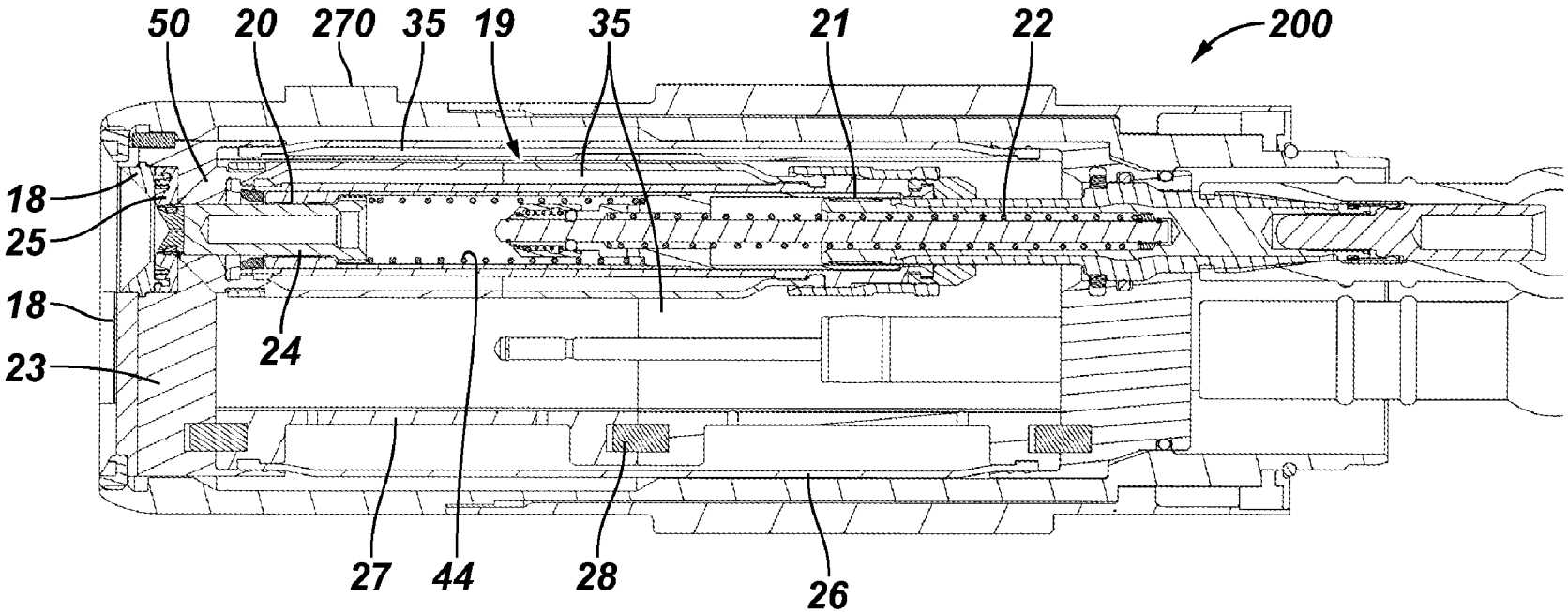
FIG. 5 is a longitudinal cross-sectional view of an example plug component according to the present invention.

FIG. 5 shows a plug component 200 which houses three oil filled sliding contact pin assemblies 19 comprising sliding contact pins with front contact bands 20 and rear contact bands 21. A spring 22 energizes the sliding contact pin assemblies 19 towards an insulation plate 23 at the opening end of the plug component 200. A shuttle pin 24 is energized by spring 44 towards and closes the opening through wiper seals 25 and 50 to retain oil inside the connector. The front and rear contact bands 20, 21 are enclosed in an oil filled pressure balanced environment using a diaphragm 26 and support insulators 27. The insulators 27 are dowelled together for orientation purposes using dowels 28.

Figure 6:
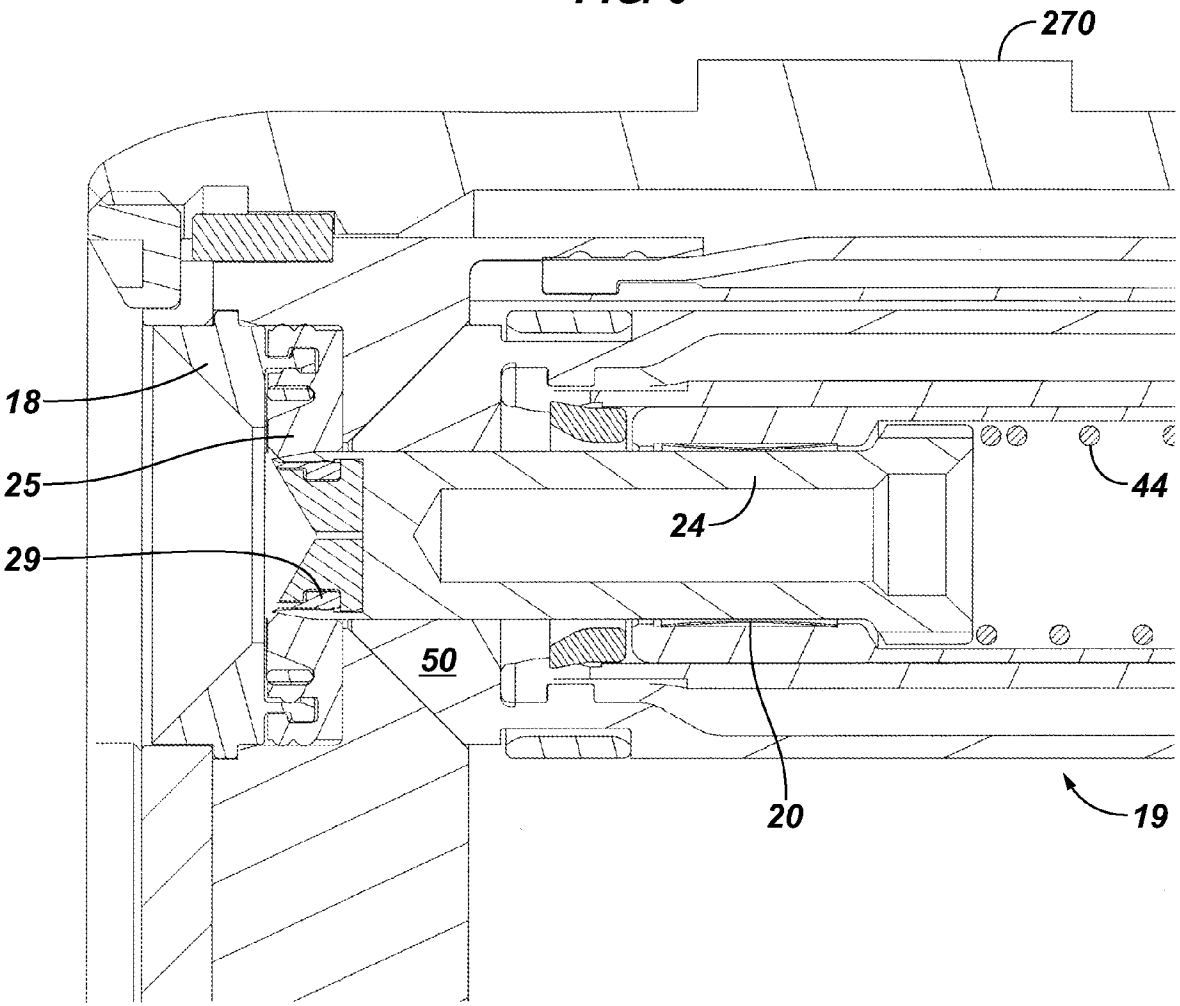
FIG. 6 is a more detailed view of the engaging end of the plug component in FIG. 5.

As shown in FIG. 6, shuttle pin seals 29 serve to hold and retain water and debris at the interface of the end (i.e., nose plug 36—see FIG. 2) of male contact pin 52 and the shuttle pin 24 when they are mated together. The insulation cones 18 mentioned above provide additional insulation and seal with the cone seals 15 of the receptacle component 100 on engagement of the connector.

Figure 7:
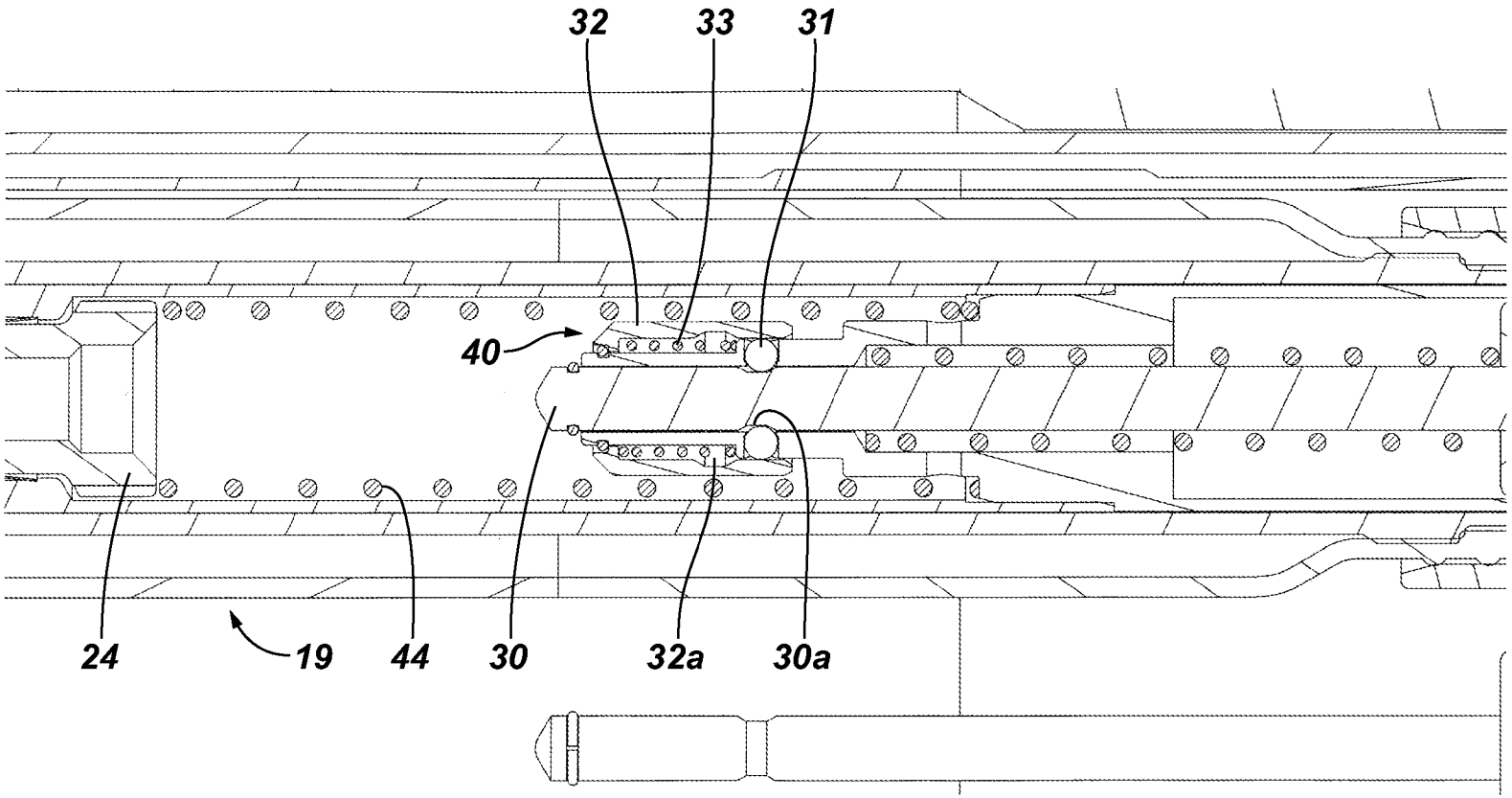
FIG. 7 is an enlarged view of the release mechanism of the plug component of FIG. 5.

A release mechanism 40 is shown in FIG. 7, which allows a two stage engagement of the connector contacts. This is to align the mating connector contact components (i.e., the contact band 3 of the male contact pin 52 and the front contact band 20 of the sliding contact pin assembly 19) of the receptacle component 100 and the plug component 200 and set the contact position before linear tolerance sliding contact action can take place. Because the contact friction is high, this release mechanism 40 is designed to overcome the limitations of a pure spring setting force, which may not be positive enough to position the contacts accurately. The release mechanism 40 comprises balls 31, the release collar 32, and spring 33. A central spring support rod 30 has undercuts 30*a* to accommodate balls 31 and together with the release collar 32 and spring 33, provides a release mechanism 40 for the linear tolerance sliding contact when the shuttle pin 24 is displaced a sufficient distance by the male contact pin 52 during engagement of the connector. Until sufficient displacement of the shuttle pin 24, the release mechanism 40 retains the sliding contact pin assemblies 19 in position relative to the central spring support rod 30.

FIGS. 8 to 12 show the mating sequence of the plug and receptacle. The first stage (not shown) is the initial engagement. At this point, the plug nose 36 of the receptacle component 100 engages the end of the shuttle pin 24 of the plug component 200, after becoming diametrically aligned and oriented through the interaction of a keyway 170 in the housing 1 of the receptacle component 100 and a tab 270 of the plug component 200 (see FIGS. 1, 5, and 9).

Figure 8:
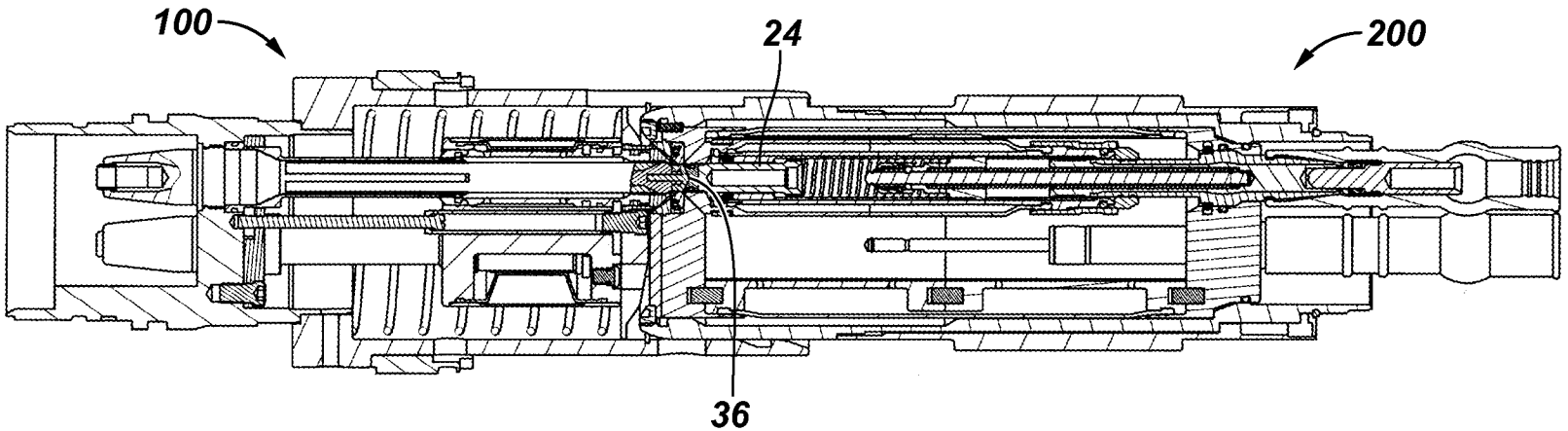
FIG. 8 is a longitudinal cross-sectional view of the mating receptacle component of FIG. 1 and plug component of FIG. 5, when the receptacle wiper seals engage the plug component insulators.
Figure 9:
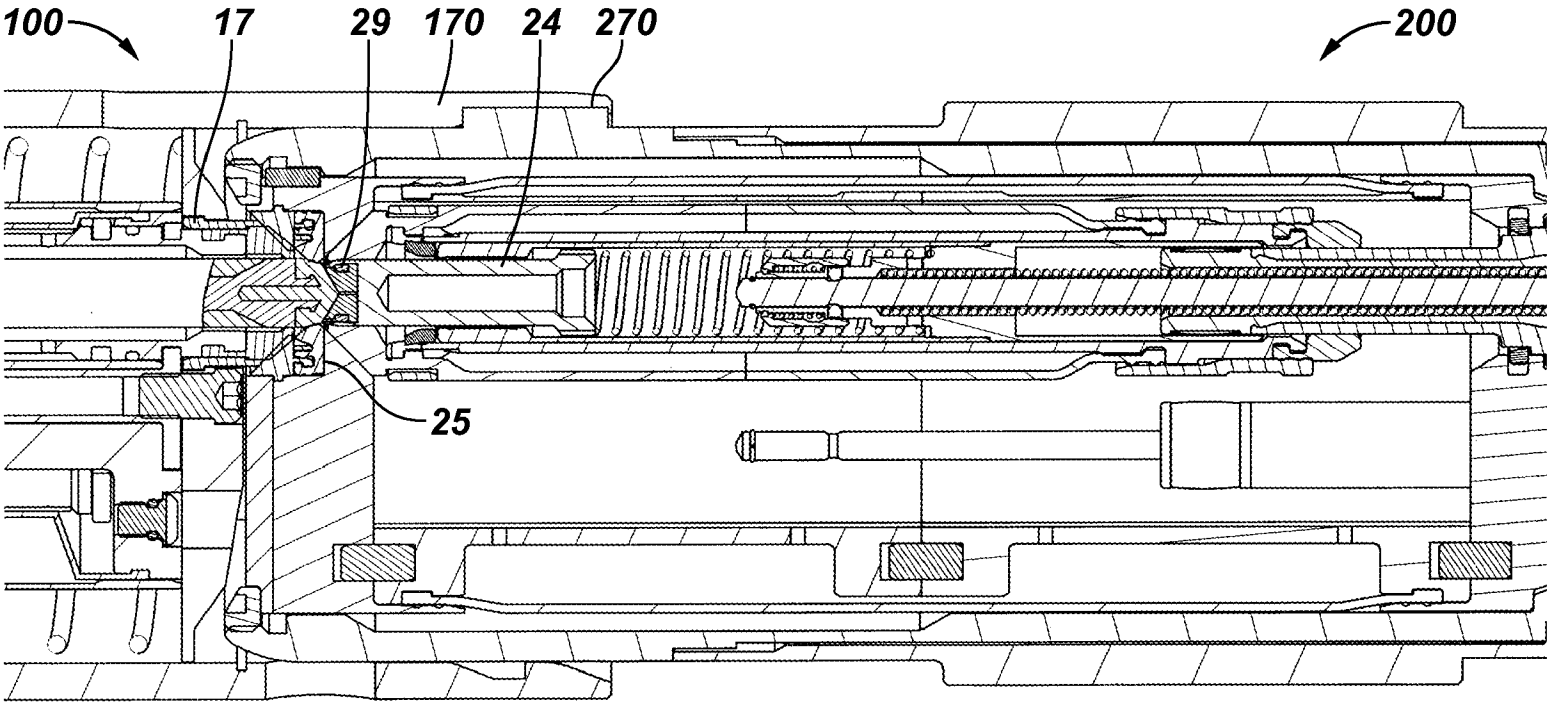
FIG. 9 is an enlarged view of the engagement stage shown in FIG. 8.

The second stage is shown in FIG. 8 and FIG. 9. The receptacle wiper seal 15 engages the plug component 200 and the wiper seals 15 and clips 17 abut the corresponding cone seals 18 to set seal engagement. The shuttle pin 24 engages the tip of the male contact pin 52 and the shuttle pin seal 29 traps debris and water, therebetween.

Figure 10:
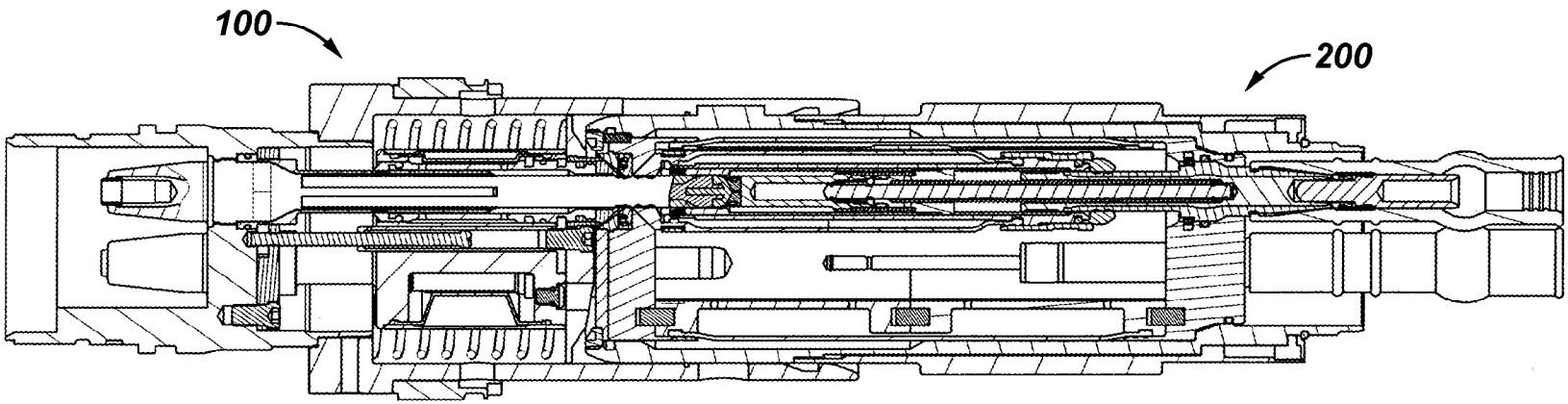
FIG. 10 is a longitudinal cross-sectional view of the mating receptacle component of FIG. 1 and plug component of FIG. 5, when the sliding contact pin in the contact assembly of the plug component is released through the release mechanism.
Figure 11:
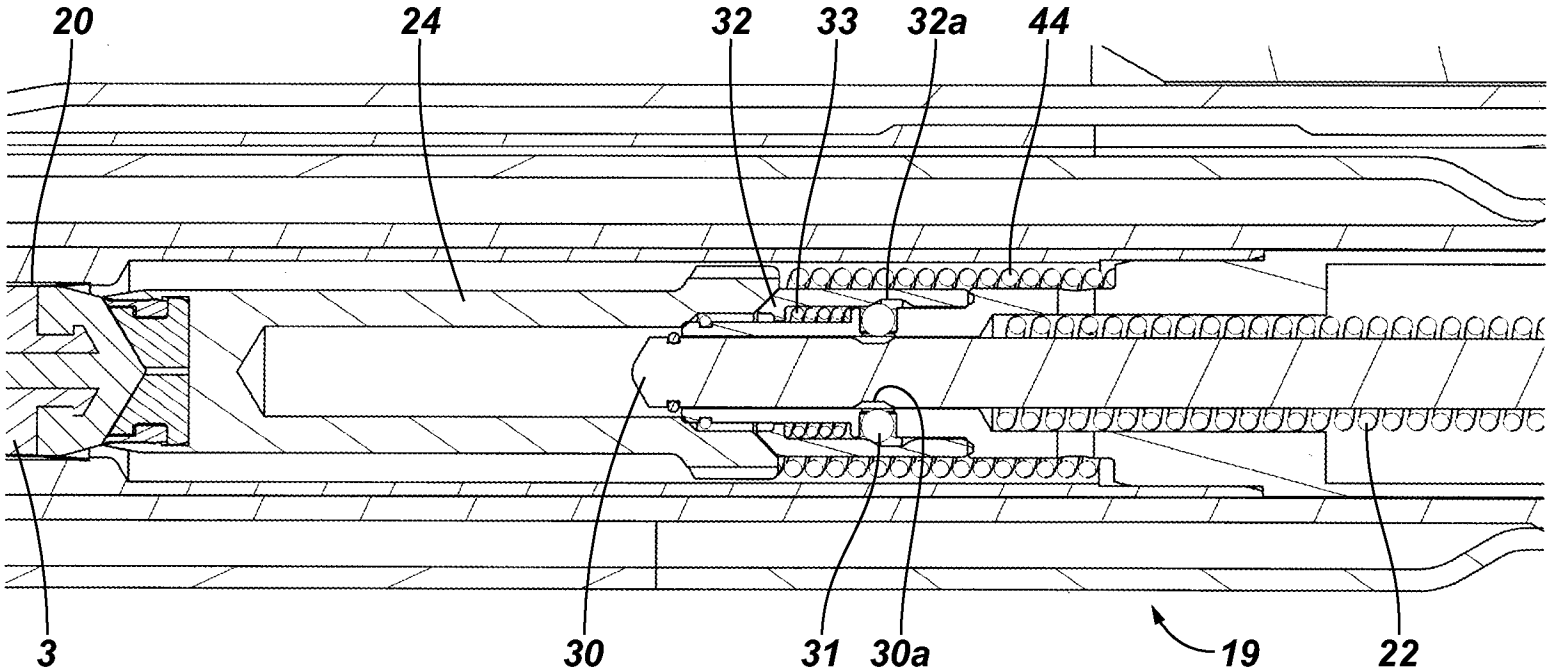
FIG. 11 is an enlarged view of the release mechanism in the position shown in FIG. 10.

The thirdstage is shown in FIG. 10 and FIG. 11. The receptacle and plug components 100, 200 engage to the point where the sliding contact pin assemblies 19 are released relative to the central spring support rod 30 through the release mechanism 40. As shown more clearly in FIG. 11, the front contact band 20 of the sliding contact pin assembly 19 is in contact with the contact band 3 of the male contact pin 52 at this point. The end of the shuttle pin 24 engages the corresponding end of the release collar 32, moving it backwards (to the right as shown in FIG. 11), thereby allowing the balls 31 to be released from the undercut 30*a* by movement into the groove 32*a*, which in turn allows relative movement between the central spring support rod 30 and the sliding contact pin assemblies 19.

Figure 12:
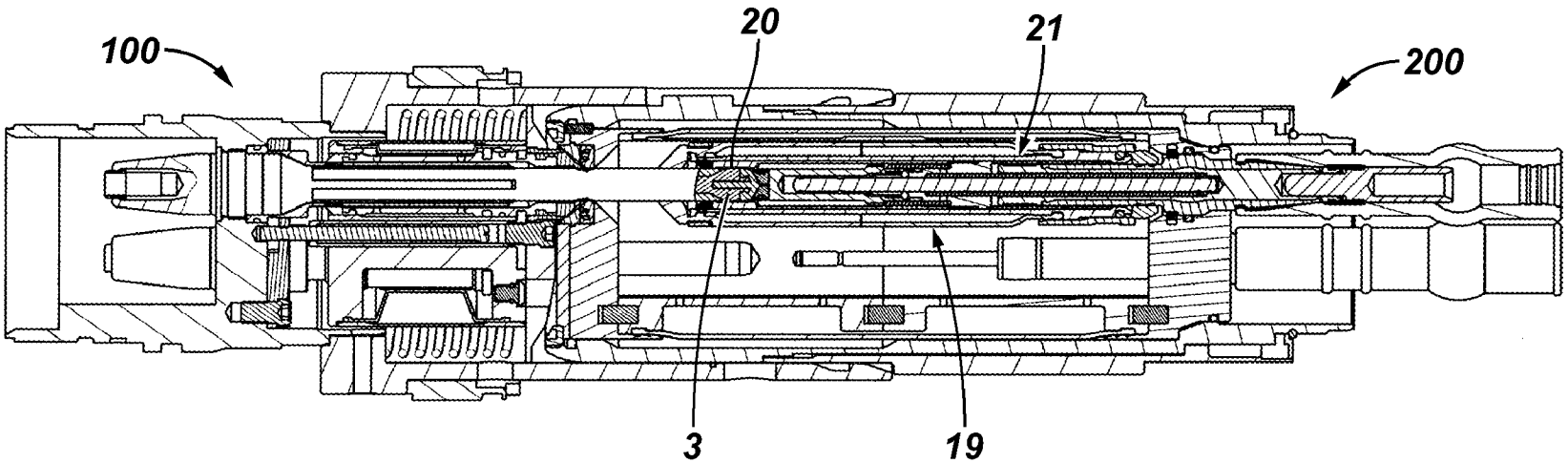
FIG. 12 is a longitudinal cross-sectional view of the mated connector.

The fourth stage is shown in FIG. 12. In this stage, receptacle component 100 is able to move relative to plug component 200 to accommodate linear tolerance sliding contact action. The difference in relative position can be seen when FIG. 10 is compared to FIG. 12. During the linear tolerance sliding contact action, front contact band 20 remains in contact with contact band 3. In addition, rear contact band 21 remains in contact with sliding contact assembly 19, thereby maintaining electrical connectivity between the receptacle connector 100 and the plug connector 200 during this movement.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. An electrical connector for use in subsea applications, the connector comprising:

a receptacle component comprising a male contact pin that comprises a contact band; and a plug component comprising a sliding contact pin assembly that further comprises:

a front contact band;

wherein initial engagement of the receptacle component and the plug component forms a watertight electrical connection between the contact band of the male contact pin and the front contact band of the sliding contact pin assembly;

wherein the receptacle component further comprises an isolation tube substantially surrounding the male contact pin over at least part of its length and containing oil therein; and wherein the watertight electrical connection is formed by a first cone seal arranged to seal around an engaging end of the male contact pin and a second cone seal arranged to seal around an engaging end of the sliding contact pin assembly.

2. A connector according to claim 1, wherein the isolation tube is made from metal.

3. A connector according to claim 1, wherein the isolation tube is made from an insulating material.

4. A connector according to claim 1, wherein the receptacle component further comprises an oil filled wiper system arranged to feed, in use, the male contact pin with oil.

5. A connector according to claim 1, wherein the receptacle component comprises three male contact pins and associated isolation tubes and a substantially triangular diaphragm surrounding the isolation tubes.

6. A connector according to claim 1, wherein the plug component further comprises:

a release mechanism provided to substantially maintain alignment between the contact band of the male contact pin and the front contact band of the sliding contact pin assembly upon further engaging of the receptacle and plug components.

7. A connector according to claim 6, further comprising a shuttle pin within the plug component and wherein the release mechanism comprises a release collar moveable within the sliding contact pin assembly, wherein, the shuttle member is arranged to abut and translate the release collar upon the further engagement of the plug component and the receptacle component.

8. An electrical connector for use in watertight applications, the connector comprising:

a receptacle component comprising:

two or more male contact pins that respectively comprise:

a contact band; and two or more isolation tubes each substantially surrounding a corresponding one of the male contact pins over at least part of its length;

a diaphragm coupled to the isolation tubes;

wherein the isolation tubes and diaphragm contain oil therein;

a plug component comprising:

two or more a sliding contact pin assemblies that respectively comprise:

a front contact band;

wherein initial engagement of the receptacle component and the plug component forms a watertight electrical connection between the contact bands of the male contact pins and the corresponding front contact bands of the sliding contact pin assemblies; and wherein the watertight electrical connection is formed by two or more first cone seals arranged to seal around engaging ends of the corresponding two or more male contact pins and two or more second cone seals arranged to seal around engaging ends of the corresponding two or more sliding contact pin assemblies.

9. The connector according to claim 8, wherein each of the sliding contact pin assemblies further comprise:

a release mechanism provided to substantially maintain alignment between the contact band of the male contact pin and the corresponding front contact band of the sliding contact pin assembly upon further engaging of the receptacle and plug components.

10. The connector according to claim 9, wherein the plug component further comprises:

two or more shuttle pins configured to activate the corresponding release mechanisms upon engagement beyond that necessary to substantially align the contact band of the male contact pin and the corresponding front contact band of the sliding contact pin assembly.

11. The connector according to claim 9, wherein each of the sliding contact pin assemblies further comprises:

a rear contact band configured to translatably maintain electrical connectivity with a distal portion of the plug component upon further engaging of the receptacle and plug components.

12. The connector according to claim 8, wherein each of the male contact pins comprises:

a conductive core electrically coupled to the contact band, and an electrically insulating material over a substantially entire length of each corresponding conductive core.

13. The connector according to claim 12, wherein the electrically insulating material further comprises one or more flutes defining oil containing passageways between the electrically insulating material and the corresponding isolation tube.

14. The connector according to claim 12, wherein the electrically insulating material further comprises one or more protrusions defining oil containing passageways between the electrically insulating material and the corresponding isolation tube.

15. An electrical connector for use in watertight applications, the connector comprising:

a receptacle component comprising:

three male contact pins that respectively comprise:

a contact band; and three isolation tubes each substantially surrounding a corresponding one of the male contact pins over at least part of its length;

a diaphragm coupled to the three isolation tubes;

wherein the isolation tubes and diaphragm contain oil therein;

a plug component comprising:

three sliding contact pin assemblies that respectively comprise:

a front contact band;

a release mechanism;

wherein initial engagement of the receptacle component and the plug component forms a watertight electrical connection between the contact bands of the male contact pins and the corresponding front contact bands of the sliding contact pin assemblies;

wherein further engagement of the receptacle component and the plug component activates each of the release mechanisms substantially maintaining alignment between each of the contact bands of the male contact pins and the corresponding front contact bands of the sliding contact pin assemblies.

* * * * *